US007699045B1

(12) United States Patent
Kronengold et al.

(10) Patent No.: US 7,699,045 B1
(45) Date of Patent: Apr. 20, 2010

(54) COMPOUND BOW WITH HIGH LIMB PRELOAD

(75) Inventors: David H. Kronengold, Tucson, AZ (US); Allen C. Rasor, Marana, AZ (US); Kevin Hansen, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 12/433,338

(22) Filed: Apr. 30, 2009

Related U.S. Application Data

(63) Continuation of application No. 12/042,414, filed on Mar. 5, 2008.

(60) Provisional application No. 61/020,261, filed on Jan. 10, 2008.

(51) Int. Cl.
*F41B 5/10* (2006.01)

(52) U.S. Cl. ..... 124/25.6

(58) Field of Classification Search ..... 124/23.1, 124/25.6, 86, 88
See application file for complete search history.

(56) References Cited

U.S. PATENT DOCUMENTS 4,739,744 A * 4/1988 Nurney ..... 124/23.1
5,040,520 A * 8/1991 Nurney ..... 124/25.6
5,174,268 A * 12/1992 Martin et al. ..... 124/25.6
5,901,692 A * 5/1999 Allshouse et al. ..... 124/23.1
5,921,227 A * 7/1999 Allshouse et al. ..... 124/25.6
6,470,870 B1 * 10/2002 Schaar ..... 124/25.6
6,712,057 B2 * 3/2004 Andrews ..... 124/23.1
6,758,204 B1 * 7/2004 Goff et al. ..... 124/25.6
7,311,096 B2 * 12/2007 Gallops, Jr. ..... 124/23.1
2005/0139200 A1 * 6/2005 Gallops, Jr. ..... 124/23.1

* cited by examiner

*Primary Examiner*—John Ricci
(74) *Attorney, Agent, or Firm*—Cahill Glazer PLC

(57) ABSTRACT

A compound archery bow having a riser and first and second limbs secured to and extending from opposite ends of the riser, each limb having an axle to support a wheel or cam; the limbs have a limb tip angle measured from an unstrung or unflexed limb position to a flexed position at brace height of at least 65° and preferably 75° or more. The bow has an axle-to-axle distance percentage change from an unstrung or unflexed condition to a brace condition of at least 20%. The limbs exhibit a limb tip angle percentage change from brace height to full draw condition of 25% or less of the total limb tip change from unflexed to full draw while the limb tip measured from an unstrung condition to a flexed condition at full draw is at least 80° and preferably 100° or more.

6 Claims, 4 Drawing Sheets

COMPOUND BOW WITH HIGH LIMB PRELOAD

CROSS-REFERENCE TO RELATED APPLICATIONS

This application is a continuation of application Ser. No. 12/042,414 filed Mar. 5, 2008 and entitled "COMPOUND BOW WITH HIGH LIMB PRELOAD", which application is related to and claims priority to a provisional application entitled "COMPOUND BOW WITH HIGH LIMB PRELOAD" filed Jan. 10, 2008 and assigned Ser. No. 61/020,261.

FIELD OF THE INVENTION

The present invention relates to archers bows, and more particularly to compound archery bows having a riser, limbs, and cams or idler wheels.

BACKGROUND OF THE INVENTION

Compound bows are provided with a riser, a pair of limbs extending from each end of the riser, and a pair of cams or a cam and a wheel are connected to the ends of the limbs. In a well known manner, as the cams or wheels are rotated by drawing the bowstring, cables connecting the cams to the opposing limbs force the limbs to bend to thus store potential energy. The amount of bending of the limb is determined in the well know manner by the shape or profile of the groove in the cam periphery upon which the cable is wound when a cam is rotated during draw. When the bowstring is released, the energy stored in the limbs is imparted to the arrow.

Bows that have a smooth discharge and deliver the potential energy that is stored in the flexed bow limbs to the arrow are very desirable. Such smooth discharge or delivery minimizes the effects of energy transfer from the bow to the arrow and also provides a significant advantage to the archer who can concentrate on his site picture and proper bowstring release. During the time that the energy is transmitted from the bow through the bowstring to the arrow, this smooth discharge imparts only little disturbance to the arrow as it initiates its flight to the target. Unfortunately, high performance bows that provide substantial potential energy and deliver such energy to an arrow do not permit such smooth discharge. The potential energy that is converted to the kinetic energy of the arrow frequently results in a "kick" or recoil sensation together with vibrations that are imparted to the shooter. These harsh sensations interfere with the archer's concentration and in some instance can make the discharge of the arrow an unpleasant moment in the shooting experience.

The energy transfer from the bow to the arrow occurs during the acceleration of the arrow as it is propelled by the bowstring. During this period of time, the effects of recoil or kick as well as other phenomena accompanying the travel of the bowstring are imparted to the arrow as it is discharged. The result of such events adversely affects the accuracy, speed, and efficiency with which the potential energy is converted to kinetic energy.

SUMMARY OF THE INVENTION

The present invention addresses these difficulties by significantly reducing the distance that mass bearing components travel during the delivery of the potential energy to the arrow. That is, by providing a significant preload to the limbs, the subsequent flexure of the limbs from brace position to full draw position and return is substantially reduced resulting in less vibration and "kick" during delivery of the potential energy of the limbs to the arrow. The limbs, in their unflexed state, are essentially flat. The limbs are bent significantly to achieve a braced condition of the bow. The result of this significant bending to the brace condition provides a highly tensioned system at brace to produce a very calm dynamic response upon shooting. The reduced limb tip movement from brace to full draw results in a bow with less vibration and less kick on the shot.

Prior art limb tip angles, measured from the unflexed limb position to the flexed limb at brace height, are usually less than about 40°. We have found that significantly increasing the limb tip angle to 65° or more, and preferably approximately 75° and the angular change in that angle from brace to full draw of 30% or less, provides unexpected calm dynamic response to each shot.

DESCRIPTION OF THE INVENTION

Figure 1A:
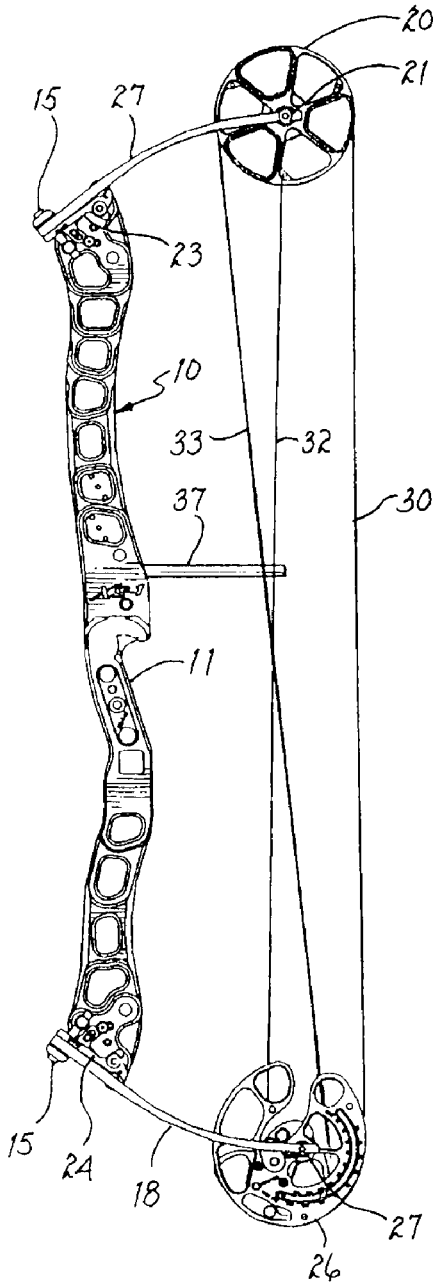
Fig. 1A (PRIOR ART)
FIG. 1A is a side elevational view of a prior art compound bow system.
Figure 1B:
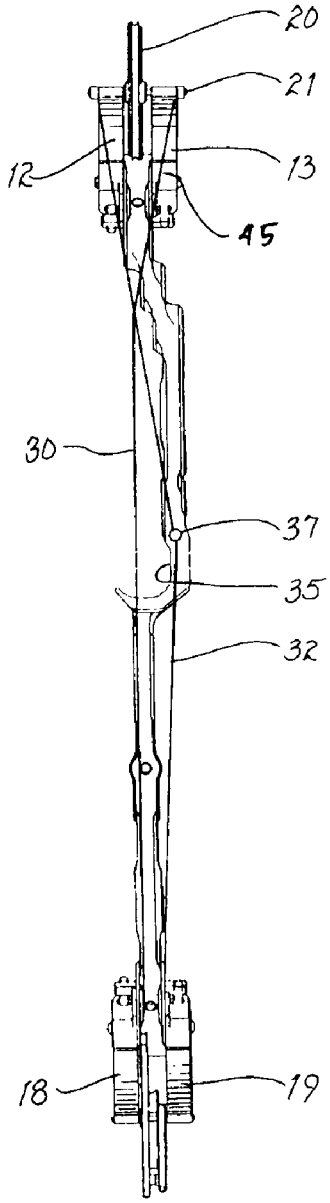
Fig. 1B (PRIOR ART)
FIG. 1B is a rear elevational view of the prior art compound bow system of FIG. 1A.

The present invention is applicable to split limb or single limb configurations and to bows incorporating a single or dual cams. Referring to FIGS. 1A and 1B, a prior art compound bow configuration is shown incorporating split limbs and a single cam configuration. The bow system includes a handle or riser 10 constructed of aluminum or other rigid material and may incorporate a grip portion 11 that may conveniently be formed to accept the palm of the shooter's hand. In practice, the grip portion 11 would normally be encased in a wood, rubber, or other formed material to conform to the shape of a shooter's palm. The upper end of the riser 10 provides support for a pair of upper flexible resilient limbs 12 and 13 clamped to the riser 10 by corresponding limb bolts such as bolt 15. The limbs 12 and 13 extend rearwardly toward the archer and support a wheel 20 mounted for rotation about a wheel axle 21. At the lower end of the riser 10 a pair of flexible resilient limbs 18 and 19 are secured to the riser through the utilization of limb bolts 15. The upper limbs 12 and 13 and the lower limbs 18 and 19 are supported by the riser 10 through the utilization of limb pockets or brackets 23 and 24. The lower limbs 18 and 19 support a cam 26 mounted for rotation about a cam axle 27. A bowstring 30 extends from the cam 26 and circumscribes the wheel 20 to return to the cam 26 to be anchored thereon. A cable 32 extends from around a cable groove provided in the cam 26 to be anchored to the wheel axle 21. The operation of the bowstring cable wheel and cam are well known to those skilled in the art and need not be described here. The principles of the invention are applicable to bow systems whether they use a single cam with a wheel or use dual cams. The riser 10 may include an offset 35 to provide clearance for arrow fletching as it is forced by the bowstring past the riser. It may be noted that a cable guard 37 extends rearwardly of the riser 10 toward the archer to laterally displace the cable 32 and the bowstring return 33 to ensure clearance in the plane of the bowstring 30 as the latter is drawn from its rest position shown in FIGS. 1A and 1B to its full drawn position. In this manner, the motion of the bowstring as it is released permits the arrow to be propelled without interference from either the bowstring return or the cable.

The sample prior art bow system utilizes dual or split limbs 12 and 13 for the upper, and dual or split limbs 18 and 19 for the lower supports for the wheel and the cam, respectively. Each of the individual limbs is independently adjustable to enable the archer to adjust each limb independently to control wheel lean and thereby minimize string and cable wear. When the individual limbs have been adjusted, the strings are provided with a straight path to their respective grooves; further, the use of dual limbs permits the axles of the respective cams and wheels to be mounted closer to the riser; that is, the dual limbs supporting the cam provide free space therebetween to permit the cam axle to be positioned closer to the riser and to permit a larger cam to be used. The present invention is equally applicable to solid as well as split limbs and to single or dual cam bows.

Figure 2A:
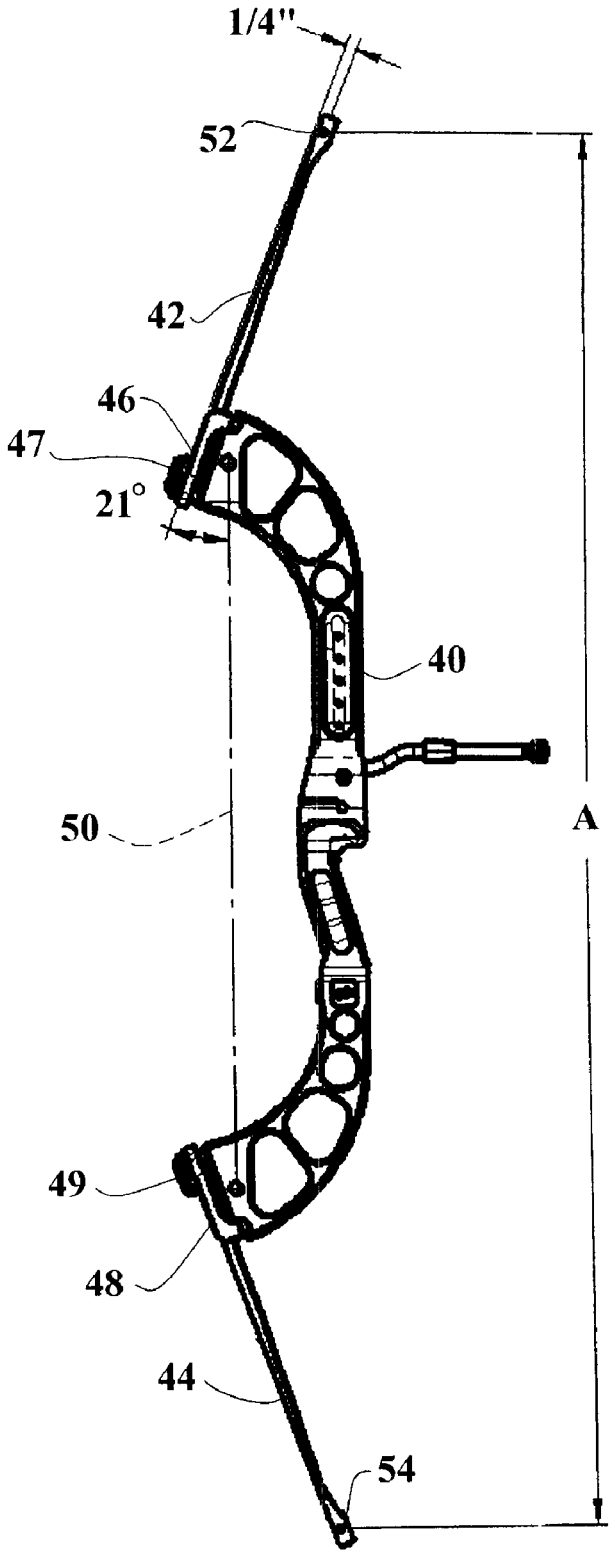
FIG. 2A is a side elevational view of a compound bow constructed in accordance with the teachings of the present invention with the cams and bowstring removed to show the limbs in an unflexed position.
Figure 2B:
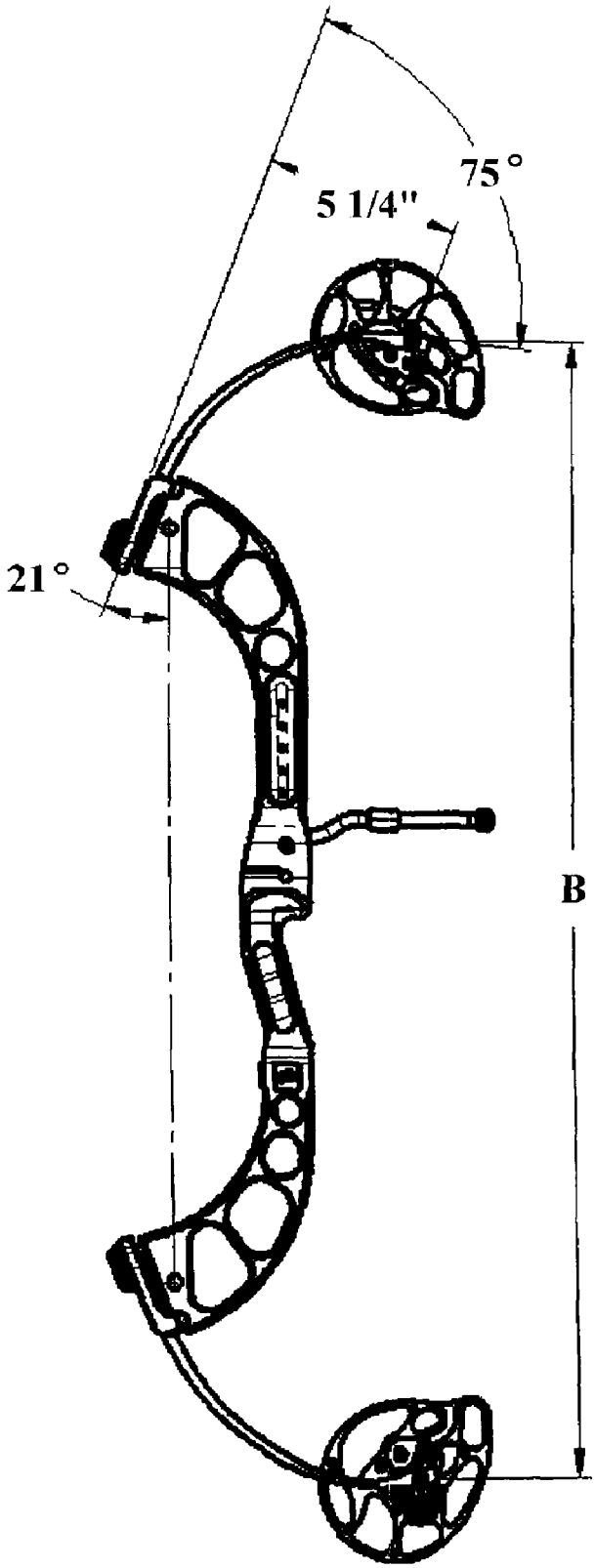
FIG. 2B is a side elevational view of the compound bow of FIG. 2A shown with the cams attached to the limbs and the limbs flexed to brace height.
Figure 2C:
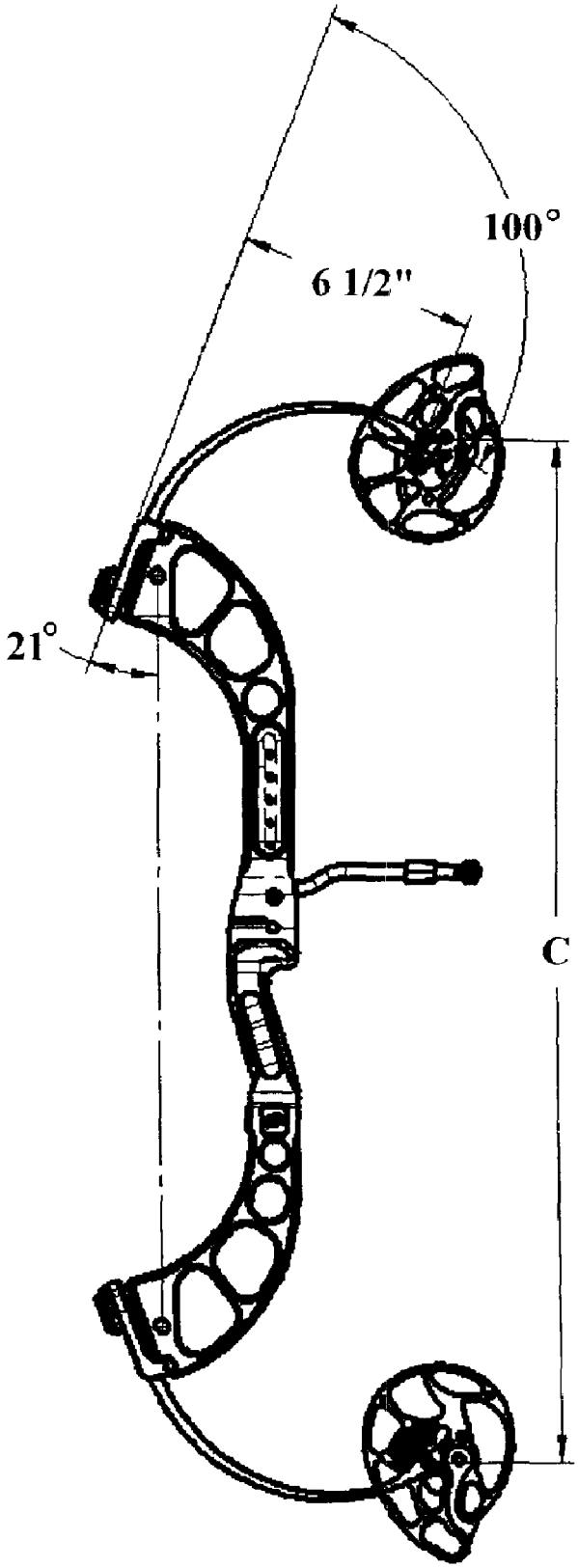
FIG. 2C is a side elevational view of the compound bow of FIGS. 2A and 2B showing the limbs flexed to full draw.

Referring to FIGS. 2A, 2B and 2C, a compound bow constructed in accordance with the teachings of the present invention is shown. FIG. 2A illustrates a bow having a riser 40 to which the limbs 42 and 44 are secured. The limbs are secured at limb pockets 46 and 48 and limb bolts 47 and 49, respectively. The limbs 42 and 44 are shown in their relaxed or unflexed state and extend from the riser 40 at an angle determined by the angle of the respective limb pockets; the limb pockets in the embodiment shown in FIG. 2A are positioned at a 21° angle with respect to a reference line 50 which is parallel to the bowstring that will be used with the compound bow.

In their relaxed or unflexed state as shown in FIG. 2A, the limbs 42 and 44 are flat; holes 52 and 54 are provided near the ends of the limbs 42 and 44, respectively, for receiving axles upon which cams or idler wheels will be mounted for rotation. For purposes of illustration, the compound bow of FIG. 2A is chosen having an unflexed or relaxed limb axle-to-axle distance A of 41½ inches. In the unflexed state the limb 42 is essentially flat while the axle hole 52 is necessarily displaced or offset from the flat surface of the limb by ¼ inch.

The illustration in FIGS. 2A, 2B and 2C is a split-limb dual-cam bow. With the cams mounted as shown in FIG. 2B and the limbs flexed to the brace position, the axle-to-axle distance B is reduced to 33 inches. The bowstring and cables are omitted from FIGS. 2B and 2C for purposes of clarity; it will be understood that cables, wheels and cams as well as bowstrings are positioned in the conventional manner well known in the art. It may be noted by reference to FIG. 2B that in the braced position, the cam axle has been displaced or offset 5¼ inches and the limb has been flexed 75° from its unflexed position. This displacement of the cam or wheel axle and the angular displacement of the limb represents a departure from prior art designs. This significant increase in brace flexure has been found to provide an unexpected advantages in the dynamics of the bow. Limb tip angles from unstrung to brace position of 65° or more significantly improves shooting dynamics.

Referring to FIG. 2C, the bow is shown in full drawn position wherein it may be seen that the axle has been displaced 6½ inches from its relaxed or unstrung position and has produced a total limb flexure of 100° or 25° more than the brace height. The axle-to-axle distance C at full draw is 29½ inches.

The following chart discloses the changes in the configuration of the compound bow disclosed in FIGS. 2A, 2B and 2C as the bow is strung, to brace height and subsequently drawn to full draw. The chart shows the respective axle-to-axle distances as well as the progressive changes in that distance as well as the percentage change in the axle-to-axle distance. Similarly, the limb tip angle is shown in the unstrung, braced and full draw position as well as the changes in that angle as the bow is drawn together with the percentage change in the tip angle. The axle offset from flat is also shown in the unstrung, braced and full draw positions together with the percentage change provided by the bow of FIGS. 2A, 2B and 2C.

The following charts present a comparison between a compound bow constructed in accordance with the teachings of the present invention and representative prior art bow constructions. Chart I provides physical dimensions of a selected bow of the invention giving axle-to-axle distances in the unstrung, braced and full draw conditions. Similarly, limb tip angles are provided for the different conditions as well as the offset.

CHART I (21° Pocket Angle, 12" Split Limb)

| | Axle-to Axle (inches) | Axle-to-Axle Change (inches) | Axle-to-Axle % Change | Limb Tip Angle (degrees) | Limb Tip Angle Change (degrees) | Tip Angle % Change | Axle Offset from Flat (inches) | Axle Offset Change (inches) | Axle Offset % Change |
|---|---|---|---|---|---|---|---|---|---|
| Unstrung | 41½ | 8½ | 26% | 0 | 75 | 75% | ¼ | 5 | 80% |
| Braced | 33 | | | 75 | | | 5¼ | | |
| Full Draw | 29½ | 3½ | 11% | 100 | 25 | 25% | 6½ | 1¼ | 20% |
| | Total | 12 | 36% | Total | 100 | 100% | Total | 6¼ | 100% |

The dimensions, or dimensional changes, of significance demonstrated by Chart I is the fact that the axle-to-axle distance percentage change from the unstrung condition to the braced condition is at least 26%. This change from unstrung to braced condition demonstrates the initial flexure or loading of the limbs while in the "ready to shoot" or static braced condition. This condition provides a significant preload on the limbs that permits reduction in the additional flexure of the limbs as the bow is drawn. This advantage is demonstrated in Chart I by the fact that the limb tip angle change from braced condition to full draw condition is only 25° or 25%. In other words, there is less flexure during this phase of the bow operation than prior art bows. Another significant aspect of the bow of the present invention can be determined from Chart I by observing the axle offset change from braced condition to full draw condition. It may be noted that this offset, expressed as a percentage of change from braced to full draw is only 20%. This axle offset change should be 25% or less and preferably 20% or less. Similarly, Chart I illustrates that the limb tip angle from unstrung to full draw is 100°; this quantity is significantly larger than provided by prior art construction. Limb tip angle changes of 80° or more permit the significant angular flexure and preload afforded by the structure of the present invention.

CHART II

Prior Art (21° Pocket Angle, 15½" Solid Limb)

| | Axle-to Axle (inches) | Axle-to-Axle Change (inches) | Axle-to-Axle % Change | Limb Tip Angle (degrees) | Limb Tip Angle Change (degrees) | Tip Angle % Change | Axle Offset from Flat (inches) | Axle Offset Change (inches) | Axle Offset % Change |
|---|---|---|---|---|---|---|---|---|---|
| Unstrung | 45½ | 6 | 15% | 0 | 35 | 58% | ¼ | 4¾ | 68% |
| Braced | 39½ | | | 35 | | | 5 | | |
| Full Draw | 35 | 4½ | 11% | 60 | 25 | 42% | 7¼ | 2/¼ | 32% |
| | Total | 10½ | 27% | Total | 60 | 100% | Total | 7 | 100% |

CHART III

Prior Art (55° Pocket Angle, 12½" Solid Limb)

| | Axle-to Axle (inches) | Axle-to-Axle Change (inches) | Axle-to-Axle % Change | Limb Tip Angle (degrees) | Limb Tip Angle Change (degrees) | Tip Angle % Change | Axle Offset from Flat (inches) | Axle Offset Change (inches) | Axle Offset % Change |
|---|---|---|---|---|---|---|---|---|---|
| Unstrung | 36 | 4¾ | 15% | 0 | 23 | 62% | ¼ | 2½ | 63% |
| Braced | 31¼ | | | 23 | | | 2¾ | | |
| Full Draw | 27¾ | 3½ | 11% | 37 | 14 | 38% | 4¼ | 1½ | 38% |
| | Total | 8¼ | 26% | Total | 37 | 100% | Total | 4 | 100% |

CHART IV

Prior Art (50° Pocket Angle, 9" Split Limb)

| | Axle-to Axle (inches) | Axle-to-Axle Change (inches) | Axle-to-Axle % Change | Limb Tip Angle (degrees) | Limb Tip Angle Change (degrees) | Tip Angle % Change | Axle Offset from Flat (inches) | Axle Offset Change (inches) | Axle Offset % Change |
|---|---|---|---|---|---|---|---|---|---|
| Unstrung | 36 | 3 | 9% | 0 | 30 | 52% | ¼ | 1¾ | 54% |
| Braced | 33 | | | 30 | | | 2 | | |
| Full Draw | 30 | 3 | 9% | 58 | 28 | 48% | 3½ | 1½ | 46% |
| | Total | 6 | 18% | Total | 58 | 100% | Total | 3¼ | 100% |

To facilitate comparison of the parameters illustrated by the above charts, the following table is helpful.

TABLE 1

| | |
|---|---|
| Bow of FIG. 2: axle-to-axle % change from unstrung to braced 26% | |
| prior art Chart II | 15% |
| prior art Chart III | 15% |
| prior art Chart IV | 9% |
| Bow of FIG. 2: limb tip angle change from braced to full draw 25% | |
| prior art Chart II | 42% |
| prior art Chart III | 38% |
| prior art Chart IV | 48% |
| Bow of FIG. 2: axle offset change from braced to full draw 20% | |
| prior art Chart II | 32% |
| prior art Chart III | 38% |
| prior art Chart IV | 46% |
| Box of FIG. 2 limb tip angle from unstrung to full draw 100° | |
| prior art Chart II | 60° |
| prior art Chart III | 37° |
| prior art Chart IV | 58° |

Reference to Table 1 above illustrates the importance of the axle-to-axle percent change dimension between the unstrung and braced conditions of the bow. It has been found that this percentage change in excess of 20% and preferably 25% to 26% or more provides the ability to preload the limbs to facilitate the minimization of cam travel during the discharge of the arrow without sacrificing the energy available for transfer to the arrow during the conversion from potential energy to kinetic energy of the arrow. Similarly, Table 1 illustrates the feature of limiting the limb tip angle change from braced to full draw. This overall limitation facilitates the transfer of potential energy in the limbs to kinetic energy of the arrow without excessive travel of the limbs and attached cams. It has been found that this limb tip angle change should be less than 30% and preferably 25% or less. The axle offset change from braced to full draw conditions is less than 25% and preferably 20% or less. The overall limb tip angle from unstrung to full draw position covers approximately 100° and it has been found that this angular relationship should exceed 75° but preferably closer to 100°.

The result of the configuration described in connection with the embodiment chosen for illustration, is that there is a high stress and flexure in the limbs at brace and that this condition stabilizes the reaction forces and dampens vibration more quickly than lower flexed brace positions. The resulting small percentage of limb movement from brace to full draw generates less movement and vibration when the bow is shot; that is, the movement of mass components such as cams and wheels is more limited and therefore less significant in the production of vibration and reaction forces. The system of the present invention maintains higher limb tension with any particular draw weight change (such as by loosening limb bolts as is common practice in the prior art) so that the bow still maintains a good "feel" even in lower weight settings.

What is claimed:

1. In a compound archery bow having a riser, first and second limbs secured to and extending from opposite ends of said riser, each limb having an axle to support a wheel or cam; at least one cam mounted for rotation on the axle of one of said limbs, and a bowstring extending from said cam to a cam or wheel on an opposite limb, the improvement comprising:

said limbs having a limb tip angle measured from an unstrung or unflexed limb position to a flexed position at brace height of at least 65°.

2. The compound archery bow of claim 1 wherein said limb tip angle is 75°.

3. In a compound archery bow having a riser, first and second limbs secured to and extending from opposite ends of said riser, each limb having an axle to support a wheel or cam; at least one cam mounted for rotation on the axle of one of said limbs, and a bowstring extending from said cam to a cam or wheel on an opposite limb, the improvement comprising:

said bow having an axle-to-axle distance percentage change from an unstrung or unflexed condition to a braced condition of at least 20%.

4. The compound archery bow of claim 3 wherein said percentage change is 25% to 26%.

5. In a compound archery bow having a riser, first and second limbs secured to and extending from opposite ends of said riser, each limb having an axle to support a wheel or cam; at least one cam mounted for rotation on the axle of one of said limbs, and a bowstring extending from said cam to a cam or wheel on an opposite limb, the improvement comprising:

said limbs having a limb tip angle measured from an unstrung condition to a flexed condition at full draw of at least 80°.

6. The compound archery bow of claim 5 wherein said limb tip angle is 100° or more.

* * * * *